United States Patent [19]

Watkins

[11] 4,415,028

[45] Nov. 15, 1983

[54] APPARATUS FOR MEASURING BOTTOM HOLE WELL CONDITIONS

[75] Inventor: Fred E. Watkins, Houston, Tex.

[73] Assignee: Camco, Incorporated, Houston, Tex.

[21] Appl. No.: 300,087

[22] Filed: Sep. 8, 1981

[30] Foreign Application Priority Data

Dec. 18, 1980 [GB] United Kingdom ..... 8040474

[51] Int. Cl.[3] ..... E21B 23/00; E21B 34/06

[52] U.S. Cl. ..... 166/206; 166/318; 166/332

[58] Field of Search ..... 166/206, 113, 118, 66, 166/318, 332; 251/74; 73/155

[56] References Cited

U.S. PATENT DOCUMENTS 4,159,643 7/1979 Watkins ..... 166/250 X 4,252,195 2/1981 Fredd ..... 166/332 X

FOREIGN PATENT DOCUMENTS 599036 3/1978 U.S.S.R. ..... 166/318

*Primary Examiner*—Ernest R. Purser

*Assistant Examiner*—Thuy M. Bui

*Attorney, Agent, or Firm*—Fulbright & Jaworski

[57] ABSTRACT

An apparatus for measuring bottom hole conditions such as pressure in the tubing of a well including a locking and sealing sub to lock into and seal against the interior of the tubing, an isolation valve connected in the sub and a measuring instrument connected to the valve for measuring conditions in the tubing. The isolation valve has a bore with an annular seat in the bore and side ports leading into the bore below the seat. A valve element is longitudinally movable in the valve between an open position below the ports and a closed position against the seat and includes an elongate mandrel having a backup shoulder. A latch mechanism initially holds the valve in the open position and includes a collet member initially engaging the mandrel and holding the valve element in the open position and the collet is held in a latched position by a spring loaded backup shoulder. Spring means yieldably urge the collet out of engagement with the mandrel and close the valve when the backup shoulder is moved out of engagement with a collet. The valve flow passageway is as large as the bore through the locking sub. A closing prong which actuates the valve to the closed position has a cross-sectional area substantially smaller than the valve passageway.

3 Claims, 4 Drawing Figures

APPARATUS FOR MEASURING BOTTOM HOLE WELL CONDITIONS

BACKGROUND OF THE INVENTION

As described in U.S. Pat. No. 4,159,643, issued July 3, 1979, measurements of bottom hole pressure are important in obtaining (1) pressure buildup characteristics in obtaining oil and/or gas well producing information, and (2) pressure fall-off in injection wells. A typical procedure in producing wells involves flowing a well at a particular rate until the bottom hole pressure has stabilized and a pressure measuring instrument is set near the well bottom and production flow is stopped until the pressure reaches a reasonably close maximum value. It is desirable to obtain the pressure buildup by closing the tubing string near the well bottom and measuring the pressure buildup below this low closure point.

The present invention is directed to an apparatus for measuring bottom hole pressure in a well as well as other well conditions which can be installed and removed by a conventional wireline operations.

SUMMARY

An isolation valve is provided which is initially locked in the open position to provide a fluid bypass when installed in a well to allow flowing in the well to obtain the desired drawdown. The isolation valve is connected to a conventional equalizing sub which is attached to a conventional locking and sealing device. A shock absorber and measuring instrument are attached to the bottom of the isolation valve. The assembly is then installed in a tubing landing nipple located as deep as practicable in the well. Flow passageways through the isolation valve are normally larger than the bore through the locking device whereby pressure drop through the valve due to flow is held to a practical minimum.

After the assembly is installed the well is produced to obtain the desired drawdown. In order to close the isolation valve, a wireline weight bar with centralizers and an actuating prong is lowered into the well against the flow. When the actuating prong contacts the isolation valve, the valve will be unlatched and as the weight bar is picked up the valve will close. The closing prong has a small cross-sectional area so as only to slightly reduce the flow area through the valve and lock as the prong is inserted.

At the end of a predetermined time interval for measuring the bottom hole pressure, the assembly is removed from the well by conventional wireline methods. The equalizing sub allows downhole equalization of pressure prior to pulling the assembly.

A further object of the present invention is the provision of an isolation valve having a bore with an annular seat in the bore and side ports leading into the bore below the seat. A valve element is longitudinally movable in the valve between an open position between the ports and a closed position seated on the seat and includes an elongate mandrel having a backup shoulder. A latch mechanism is provided for initially holding the valve element in an open position including a collet member initially engaging the mandrel and holding the valve element in the open position. The collet engages and is held in a latched open position by the backup shoulder. Spring means yieldably urge the collet out of engagement with the mandrel and close the valve when the backup shoulder is moved out of engagement with the collet.

DESCRIPTION OF THE PREFERRED EMBODIMENT

Figure 1:
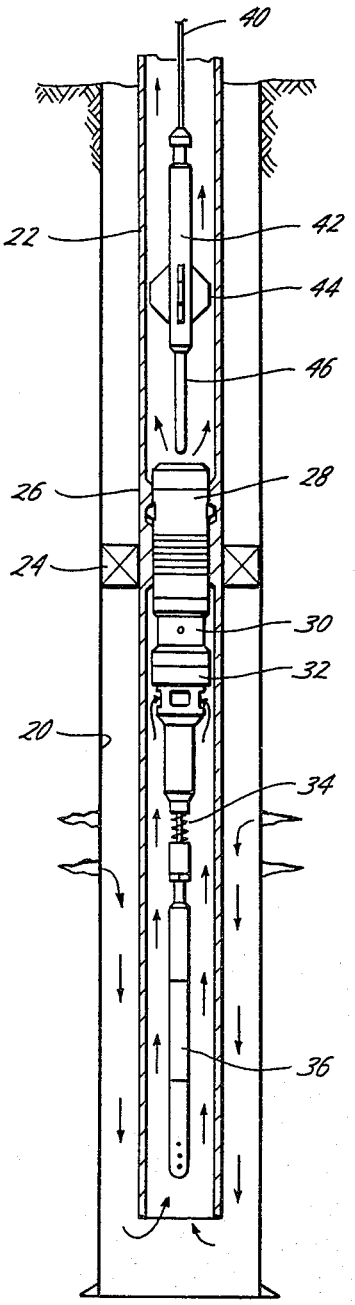
FIG. 1 is a schematic elevational view of the assembly of the present invention positioned adjacent the bottom of the well tubing with the closing prong in position to actuate and close the isolation valve.

Referring now to FIG. 1, a conventional well bore 20 is shown having a tubing 22 therein and a packer 24 therebetween whereby production from the well bore flows into the lower end of the tubing 22. The tubing 22 includes a conventional landing nipple 26 such as Camco Type DS.

The assembly of the present invention which is installed in the lower end of the tubing 22 by a conventional wireline operation includes a well lock 28, such as a Camco CS lock, which lands in, seals and locks in the landing nipple 26, a conventional equalizing sub 30, the isolation valve 32 of the present invention, which in turn supports a shock absorber 34 which holds a conventional bottom hole instrument 36 such as a pressure measuring instrument although other types of measuring instruments such as temperature measuring instrument may be used. The assembly is installed as low as practicable in the tubing 22 to eliminate the storage effect of the tubing string and provide a production shutoff adjacent the bottom of the tubing string 22. As will be more fully described hereinafter the isolation valve 32 is installed in the open position and after installation the well is produced through the isolation valve 32 to obtain the desired drawdown. That is, the fluid flowing from the well bore 20, flows through the bottom end of the tubing 22 and into the isolation valve 32, through the equalizing sub 30, through the bore of the well lock 28 and up the tubing string 22.

After the desired drawdown is reached, a wireline 40 is lowered into the tubing 22 and includes a weight bar 42, a centralizer 44, and a closing prong 46. As will be more fully described, when the prong 46 engages the isolation valve 32, the valve will become unlatched. As the wireline 40 is picked up, the isolation valve 32 will close and the pressure instrument 36 can measure the pressure change below the closed valve 32. After completing the test, the assembly is removed from the tubing 22 by conventional wireline operation after equalization.

Figure 2:
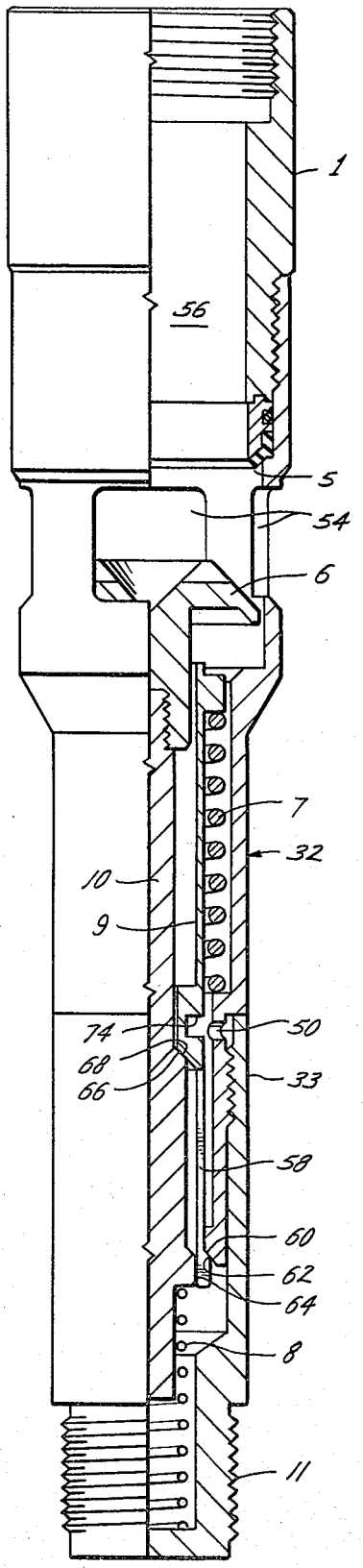
FIG. 2 is an enlarged elevational view, in cross section of the isolation valve of the present invention shown in the open position.

Referring now to FIG. 2, the reference numeral 32 generally indicates the isolation valve of the present invention and has a housing 33 and generally includes an upper end 1 for support from the equalizing sub 30 and well lock 28 (FIG. 1) and a lower end body connector 11 for supporting the shock absorber 34 and pressure instrument 36 (FIG. 1). The valve 32 (FIG. 2) also includes a plurality of ports 54 and a bore 56 providing flow passages through the valve 32 which are normally larger than the bore through the well lock 28 whereby pressure drop due to flow is held to a minimum. A valve element plunger 6 is provided for longitudinal movement in the valve 32 and is shown in the open position (FIG. 2) and when allowed to move upwardly will seat on the seat 5 (FIG. 4) and close fluid flow therethrough. A mandrel 10 is connected to the valve element plunger 6.

However, a latch mechanism is provided to initially hold the valve element 6 in the open position, but which is unlatched by the action of the prong 46 engaging the plunger 6. Thus, a release collet 9 is provided having fingers 58 and shoulders 60 which initially coact with shoulder 62 on housing 33 and are held in the latched position by a backup shoulder 64 on the mandrel 10. Coacting shoulders 66 and 68 on the collet 9 and mandrel 10, respectively, holds the valve initially in the open position. A spring 8 acts against the mandrel 10 primarily to keep backup shoulder 64 in the latched position. A return spring 7 acts on the release collet 9 in a direction to release the latch and close the valve.

Initially, the valve 32 is manually locked in the open position (FIG. 2) to provide a fluid bypass through the ports 54 when installing the assembly of FIG. 1 in the landing nipple 26. The manual locking is accomplished by partially unscrewing the body connector 11 to expose opening 50 and the plunger 6 and collet 9 are manually pushed to the downward position, and a rod or screwdriver is inserted into the opening 50 to engage a slot 74 in the collet 9 to hold the collet in the latched position, and the plunger 6 and collet 9 are released from the top. The shoulders 60 and 62 are then engaged, the backup shoulder 64 sets the latch, but is prevented from further upward movement by coacting shoulders 66 and 68 between the mandrel 10 and collet 9, respectively.

Figure 3:
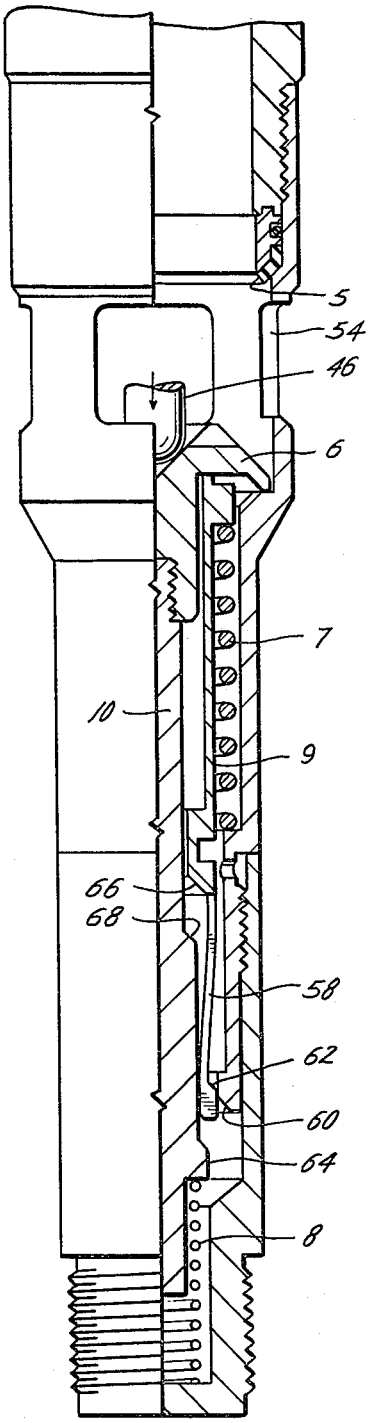
FIG. 3 is a view similar to FIG. 2 showing the latch of the valve being unlocked by a downwardly moving prong.
Figure 4:
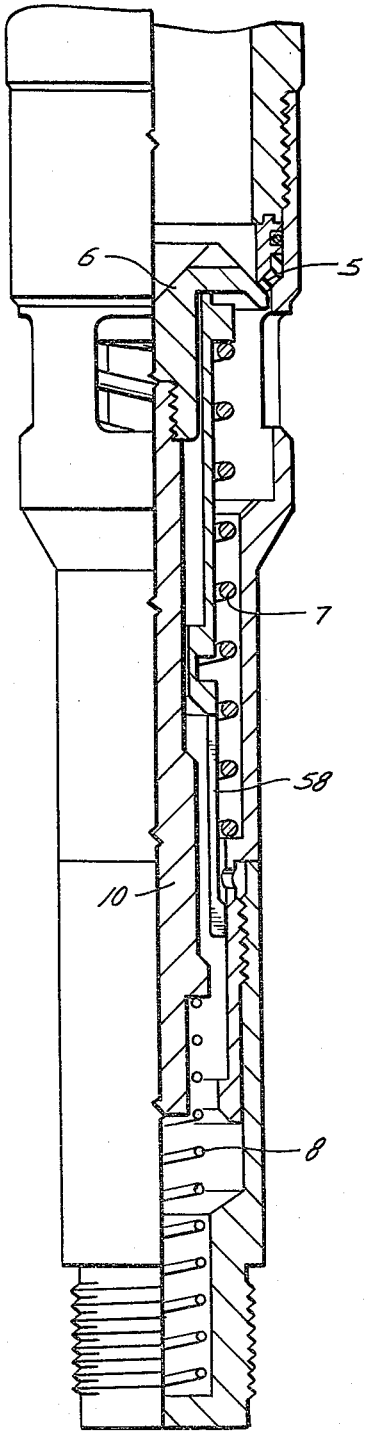
FIG. 4 is a view similar to FIG. 2 showing the valve in a closed position.

When it is desired to close the isolation valve 32, the closing prong 46 is lowered into the tubing 22, as best seen in FIGS. 1 and 3, and engages the top of the valve element plunger 6. It is to be noted that the cross-sectional area of the prong 46 is considerably less than the bore 56 of the valve 32 whereby the small prong 46 only slightly reduces the flow area through the lock 28 and valve 32. Downward actuation of the plunger 6 by the closing prong 46 moves the mandrel 10 downwardly removing the backup shoulder 64 from behind the collet fingers 68 whereby the return spring 7 moves the collet 9 upwardly thereby unlocking the latched shoulders 60 and 62. Thereafter, as the prong 46 is released, the primary closing force comes from spring 7 acting against the collet 9 which in turn pushes against the bottom of the plunger 6 to seat the plunger 6 on the valve seat 5 and close the valve as best seen in FIG. 4.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts, will readily suggest themselves to those skilled in the art and which are encompassed within the spirit of the invention and the scope of the appended claims.

What is claimed is:

1. An apparatus for use in the tubing of a well for shutting off flow through the tubing comprising, an isolation valve having a bore with an annular seat in the bore, side ports leading into the bore below said annular seat, a valve element longitudinally movable in the valve between an open position below said ports and a closed position seated on the seat, said valve including means for supporting a measuring instrument below said valve, said valve element having an elongate mandrel having a backup shoulder, a longitudinally movable latch mechanism for initially holding the valve element in the open position including, a longitudinally movable collet initially engaging the mandrel and holding the valve element in the open position, said collet engaging and held in a latched open position by the backup shoulder, means initially holding the backup shoulder against the collet, spring means urging the valve element to the closed position when the backup shoulder is longitudinally moved out of engagement with the collet.

2. The apparatus of claim 1 including, a prong having a cross-sectional area substantially smaller than said bore adapted to engage the valve element and move the backup shoulder downwardly out of engagement with the collet.

3. An apparatus for measuring bottom hole pressure in the tubing of a well for use in a well lock in a landing nipple in the tubing comprising, an isolation valve having a bore with an annular seat in the bore, side ports leading into the bore below said annular seat, a valve element longitudinally movable in the valve between an open position below said ports and a closed position seated on the seat, said valve element having an elongate mandrel having a backup shoulder, spring means urging said mandrel upwardly, a latch mechanism for initially holding the valve element in the open position including, a collet member initially engaging the mandrel and holding the valve element in the open position, said collet engaging and held in a latched open position by the backup shoulder, spring means urging the collet upwardly for engaging and moving the valve element to the closed position when the backup shoulder is moved out of engagement with the collet.

* * * * *